US007522143B2

(12) United States Patent
Park et al.

(10) Patent No.: US 7,522,143 B2
(45) Date of Patent: Apr. 21, 2009

(54) LIQUID CRYSTAL DISPLAY DEVICE

(75) Inventors: Chul-Woo Park, Suwon-si (KR); Tae-Soo Kim, Suwon-si (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 618 days.

(21) Appl. No.: 11/326,694

(22) Filed: Jan. 6, 2006

(65) Prior Publication Data

US 2006/0164370 A1 Jul. 27, 2006

(30) Foreign Application Priority Data

Jan. 24, 2005 (KR) ..... 10-2005-0006400

(51) Int. Cl.
*G09G 3/36* (2006.01)

(52) U.S. Cl. ..... 345/98; 345/87; 345/99

(58) Field of Classification Search ..... 345/38, 345/42, 48, 51, 55, 87–100, 102, 204, 208, 345/209, 214
See application file for complete search history.

(56) References Cited

U.S. PATENT DOCUMENTS 6,825,824 B2 * 11/2004 Lee ..... 345/89
7,071,930 B2 * 7/2006 Kondo et al. ..... 345/204
7,304,624 B2 * 12/2007 Lee ..... 345/89
7,312,794 B2 * 12/2007 Zehner et al. ..... 345/214
7,321,351 B2 * 1/2008 Cheon ..... 345/89
2005/0151712 A1 * 7/2005 Pai ..... 345/98

FOREIGN PATENT DOCUMENTS

JP 2000-148096 A 5/2000
JP 2000-347636 A 12/2000

* cited by examiner

*Primary Examiner*—Richard Hjerpe
*Assistant Examiner*—Mansour M Said
(74) *Attorney, Agent, or Firm*—Christie, Parker & Hale, LLP

(57) ABSTRACT

The present invention relates to a liquid crystal display device with a source driver in which a signal without a significant delay is generated, which has a fast response speed and provides a liquid crystal display device having a scan driver comprising a memory in which gradation data values are stored in a lookup table and which sequentially outputs a plurality of switching signals corresponding to the gradation data inputted The device also includes a switching part to which the plurality of switching signals are applied to sequentially select a plurality of voltage levels so that a plurality of pulse waveforms corresponding to the selected plurality of voltage levels are sequentially applied to the respective pixels including liquid crystal cells during one frame, wherein the liquid crystal display further includes a voltage generation part for producing the plurality of voltage levels, the memory outputs a switching signal for resetting the liquid crystal cells in the early stage of each frame, and the liquid crystal cells are OCB liquid crystal cells.

13 Claims, 6 Drawing Sheets

LIQUID CRYSTAL DISPLAY DEVICE

CROSS REFERENCE TO RELATED APPLICATIONS

This application claims priority to and the benefit of Korean Patent Application No. 10-2005-0006400, filed on Jan. 24, 2005, the disclosure of which is incorporated herein by reference in its entirety.

BACKGROUND OF THE INVENTION

1. Field of the Invention

The present invention relates to a liquid crystal display device. Specifically, to a liquid crystal display device with a source driver in which a significant signal delay is not generated, and which has a fast response speed.

2. Description of Related Art

Recently, weight reduction and shape thinning of display devices have been required to conform to the weight reduction and shape thinning of personnel computers, televisions, etc. Therefore, flat panel displays, such as liquid crystal displays (LCDs) are being developed accordingly to meet these requirements instead of CRTs (cathode ray tubes).

LCDs are display devices for obtaining a desired image by applying an electric field to liquid crystals having an anisotropic dielectric constant placed (i.e., injected) between two substrates and controlling electric field intensity, thereby controlling an amount of light transmitted onto the substrates from an external light source (backlight).

Generally, LCD devices have already been widely used as screen display devices for portable information appliances such as cellular phones, computers and personal digital assistants (PDAs) since they are thinner, lighter and consume less electric power compared with CRTs. Further, LCD devices are commonly used in certain fields because fewer electromagnetic waves are emitted from LCD devices than from CRTs.

LCD devices are typically used as display devices in portable flat panel displays, and a thin film transistor-liquid crystal display (TFT-LCD), in which a thin film transistor is used as a switching device, is commonly used in the LCD devices.

Generally, LCD devices are categorized according to the method for displaying color images into color filter type LCD devices and field sequential driving type LCD devices.

The color filter type LCD devices display desired images by forming a color filter layer including three primary colors of red (R), green (G) and blue (B) on one of two substrates and controlling an amount of light transmitted onto the color filter layer. The color filter type LCD device displays desired images by controlling an amount of light transmitted onto the R, G and B color filter layers, thereby combining the R, G and B colors when transmitting light irradiated from a single light source through R, G and B color filter layers.

In an LCD device for displaying images by using the single light source and the three color filter layers, the LCD device requires three times as many pixels as an LCD device for displaying images by using black and white colors since each display point in the device is composed of three unit pixels corresponding to R, G and B regions. Therefore, a technology for delicately fabricating these complex LCD panels is required to obtain images of high resolution. Further, it is inconvenient to fabricate the LCD devices since each color filter layer should be formed on a separate substrate, and consequently the luminance of the LCD device is reduced because the light transmittance of each color filter is low.

The field sequential driving type LCD device obtains full color images by lighting independent light sources of R, G and B colors sequentially and periodically and applying corresponding color signals to each respective pixels and synchronizing the lighting cycles of the light sources. Specifically, the field sequential driving type LCD device displays images by sequentially time-share displaying lights of the three primary colors of R, G and B that are outputted from R, G and B backlights onto one pixel where the one pixel is not divided into separate R, G and B unit pixels, thereby creating a persistent image for the eyes.

The field sequential driving type LCD devices are further divided into analog driving type LCD devices and digital driving type LCD devices. The analog driving type LCD device displays gradation in a transmission at a level that corresponds to the gradation voltage applied. This is done by setting a plurality of gradation voltages corresponding to the number of gradations to be displayed and selecting one gradation voltage corresponding to gradation data from the gradation voltages so that a liquid crystal panel is driven by the selected gradation voltage.

On the other hand, the digital driving type LCD device displays a gradation by constantly applying a driving voltage to liquid crystals and controlling an applying time of the driving voltage. According to the digital driving type LCD device, a gradation is displayed by constantly maintaining a driving voltage and timely controlling the voltage applying state and the voltage non-applying state, thereby controlling an amount of light that is transmitted through the liquid crystals.

LCD devices have a drawback of having a narrow viewing angle since light, darkness and color tone change according to the screen viewing direction. Various methods for overcoming this drawback have been suggested.

For example, in order to improve the viewing angle of an LCD device, a method for improving the vertical luminance as much as 30% or more by attaching a prism film to the surface of a light guide plate may be used, thereby improving the straightness of incident light from the backlight of the LCD device. A method for increasing the viewing angle by attaching a negative light compensation plate to the surface of the light guide plate may also be used.

Further, although the in-plane switching mode provides vertical and horizontal viewing angles of 160 degrees which is a wide viewing angle that is almost on the same level with cathode-ray tubes, an improved countermeasure for a lower opening ratio is necessary because the in-plane switching mode has a relatively lower opening ratio.

Additionally, a lot of attempts for improving viewing angle of the LCDs concentrate on providing optically compensated bend (OCB) mode LCD devices, polymer dispersed liquid crystal (PDLC) mode LCD devices and deformed helix ferroelectric (DHF) mode LCD devices using thin film transistors (TFTs). Particularly, the OCB mode LCD devices are currently actively being studied due to their benefits of fast response speed and wide viewing angle of liquid crystals.

FIG. 1 is a liquid crystal state diagram for explaining the operation of an ordinary OCB mode LCD device.

Referring to FIG. 1, the initial alignment state of liquid crystals positioned between an upper plate electrode and a lower plate electrode is the homogeneous state, and when a certain voltage is applied to the upper and lower plate electrodes, the liquid crystals operate in OCB mode after the homogeneous state is converted into the bend state through transient splay and asymmetric splay.

As illustrated in FIG. 1, formed OCB mode liquid crystal cells generally have about 10 to 20 degrees of tilt angle and 4 to 7 μm of thickness, and an alignment film of the liquid crystal cells is rubbed in the same direction. A high voltage is applied to the liquid crystal molecules to form the tilt angle of the liquid crystal molecules at 90 degrees in the center of the liquid crystal layer. A voltage to be applied to the liquid crystal molecules is varied to modulate polarization of light passing through the liquid crystal layer by changing the tilt of the rest of the liquid crystal molecules except the alignment film and the liquid crystal molecules in the center of the liquid crystal layer. The alignment of liquid crystal molecules in the center of a liquid crystal layer is horizontally symmetrical so that a tilt angle of the liquid crystal molecules at a specific voltage or less is zero degrees, and the tilt angle of the liquid crystal molecules at a specific voltage or more is 90 degrees. It generally takes several seconds to arrange the liquid crystal molecules of a central portion of the liquid crystal layer to have a tilt angle of 0 to 90 degrees. A reaction time of the liquid crystal molecules is very fast at about 10 μs since the arrangement is a bending deformation having a highly elastic coefficient without back-flow.

The above described conventional LCD device includes an LCD panel equipped with a plurality of pixels, a source driver, a scan driver and a backlight for driving the LCD panel. Therefore, scan signals are sequentially applied from the scan driver, and a data voltage is synchronized with the scan signals to be applied from the source driver to corresponding pixels so that transmittance of liquid crystals is changed according to the applied voltage, wherein a light is cast on the LCD panel from the backlight so that a screen image is displayed by emitting the light in a luminance corresponding to the transmittance of the liquid crystals.

FIG. 2 is a block diagram illustrating a source driver of a conventional LCD device. Referring to FIG. 2, a source driver 20 of the conventional LCD device includes a digital to analog converter 21 and an amp/buffer 22. The digital to analog converter 21 outputs the converted voltage value by receiving gradation data for red R, green G and blue B that corresponds to screen display data and converting the gradation data into an analog voltage value. The amp/buffer 22 amplifies the analog voltage value so that the amplified analog voltage value is output to an LCD panel 10.

However, a slew rate is limited in the above mentioned source driver 20 of the conventional LCD device due to technical limitations of the operation of the amplifier included in the amp/buffer 22. That is, output of the amp/buffer 22 is amplified with a time delay compared with an expected voltage value correspondingly to the analog voltage value that is the input of the amp/buffer 22. Since this phenomenon limits the frame frequency of an OCB mode LCD device, the conventional LCD device has the problem that the benefit of a fast response speed possessed by the OCB mode LCD device is not sufficiently exhibited.

SUMMARY OF THE INVENTION

Therefore, in order to solve the foregoing problem of the prior art, it is a feature of the present invention to provide a LCD device having a new source driver capable of expressing various gradations using only a few voltage levels.

In order to achieve the foregoing object, the present invention provides an LCD device including an LCD panel including a plurality of pixels which are formed on a region where a plurality of scan lines and a plurality of data lines cross each other and include OCB liquid crystal cells including a common electrode, a pixel electrode and OCB liquid crystals; a scan driver for applying a scan signal for selecting the plurality of pixels through the plurality of scan lines; a source driver for sequentially applying a plurality of pulse waveforms to the plurality of pixels through the plurality of data lines; a backlight part for applying a light source to the LCD panel; a backlight controller for applying a backlight voltage to the backlight part; and a timing controller for applying control signals for controlling movements of the scan driver, the source driver and the backlight controller, wherein the source driver includes a memory in which gradation data values are stored in a lookup table format, and which sequentially outputs a plurality of switching signals corresponding to the gradation data inputted; and a switching part to which the plurality of switching signals are applied to sequentially select a plurality of voltage levels, and which sequentially applies to the respective pixels a plurality of pulse waveforms corresponding to the selected plurality of voltage levels during one frame.

BRIEF DESCRIPTION OF THE DRAWINGS

The above and other features of the present invention will become more apparent to those of ordinary skill in the art by describing in detail certain exemplary embodiments thereof with reference to the attached drawings in which.

DETAILED DESCRIPTION

Figure 1:
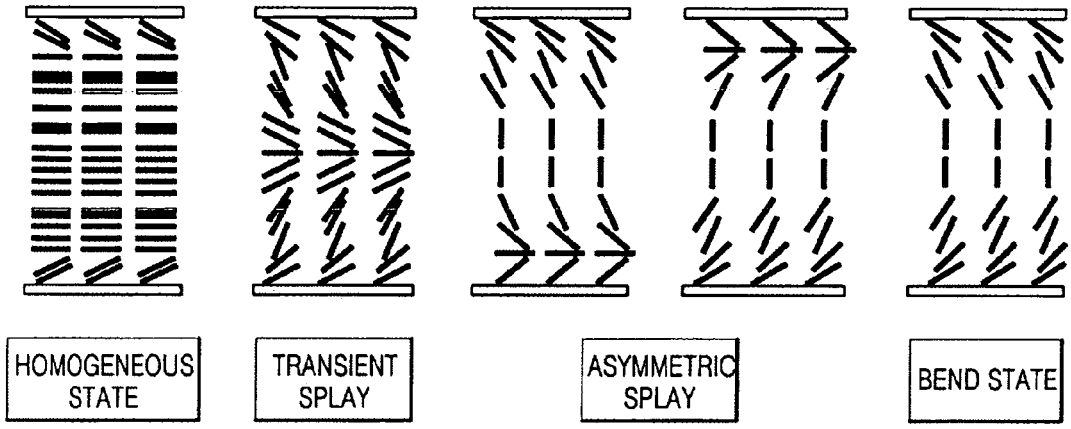
FIG. 1 is a liquid crystal state diagram for explaining operation of an ordinary OCB mode LCD device.

The present invention will now be described in detail in connection with certain exemplary embodiments with reference to the accompanying drawings. In the drawings, like reference characters designate like elements throughout several views.

Figure 3:
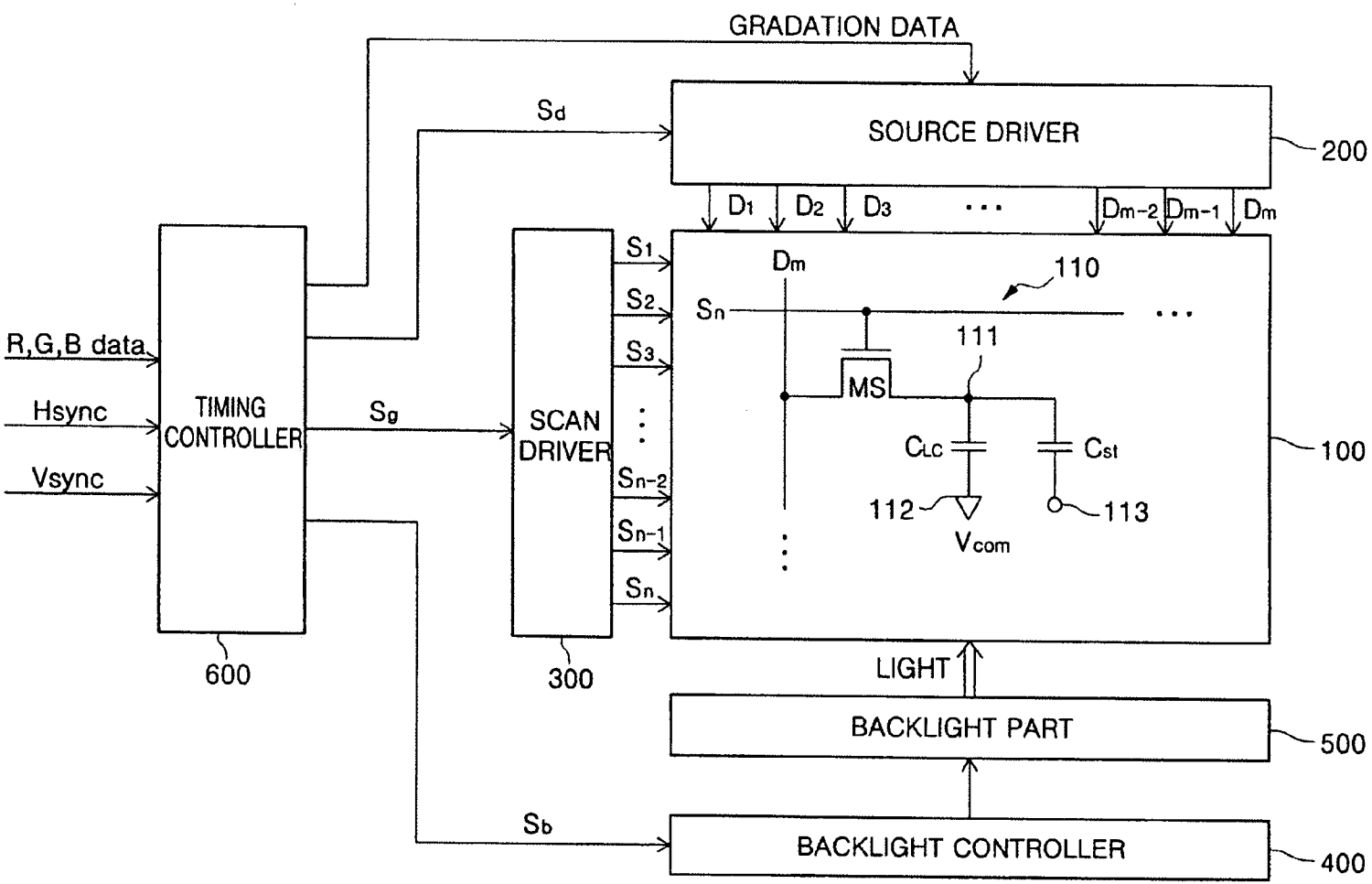
FIG. 3 is a block diagram illustrating an LCD device according to exemplary embodiments of the present invention.

FIG. 3 is a block diagram illustrating an LCD device according to exemplary embodiments of the present invention.

Referring to FIG. 3, the LCD device according to exemplary embodiments of the present invention includes an LCD panel 100, a source driver 200, a scan driver 300, a backlight controller 400, a backlight part 500 and a timing controller 600.

The LCD panel 100 includes a plurality of pixels 110 formed on a region wherein a plurality of scan lines S1-Sn and a plurality of data lines D1-Dm cross each other so that a screen image is displayed. In FIG. 3, a pixel 110 connected to an n th scan line Sn and an m th data line Dm in N×M units of pixels is depicted as a part of the LCD panel 100. Each of the pixels 110 includes switching transistor MS, OCB liquid crystal cell $C_{LC}$ and storage capacitor $C_{ST}$.

A source terminal of the switching transistor MS is connected to the data line Dm, and a gate terminal of the switching transistor MS is connected to the scan line Sn. The switching transistor MS is switched on by a scan signal applied through the scan line Sn and transmits a data voltage applied through the data line Dm to the OCB liquid crystal cell $C_{LC}$.

The OCB liquid crystal cell $C_{LC}$ includes a pixel electrode 111, a common electrode 112 and an OCB liquid crystal layer between the pixel electrode 111 and the common electrode 112. The pixel electrode 111 is connected to a drain terminal of the switching transistor MS such that the data voltage transmitted through the data line Dm is applied to the pixel electrode 111. A common voltage Vcom is applied to the common electrode 112 that is an electrode oppositely disposed to the pixel electrode 111. A voltage difference between a voltage applied pixel electrode 111 and a voltage applied common electrode 112 changes the alignment state of OCB liquid crystal molecules so that a transmittance varies according to the polarization state of light passing through the OCB liquid crystal layer.

The storage capacitor $C_{ST}$ includes a pixel electrode 111, a storage electrode 113 and an insulation layer (e.g., a dielectric layer) between the pixel electrode 111 and the storage electrode 113, wherein the storage electrode 113 is connected to the common electrode 112 of the OCB liquid crystal cell $C_{LC}$. Therefore, the storage capacitor $C_{ST}$ is connected to the OCB liquid crystal cell $C_{LC}$ in parallel and plays a role of storing the data voltage for a certain period of time.

The scan driver 300 sequentially applies scan signals through a plurality of scan lines S1-Sn, and the source driver 200 sequentially applies a plurality of pulse waveforms to corresponding pixels through a plurality of data lines D1-Dm to display an LCD panel 100. The structure in which the produced plurality of pulse waveforms are sequentially applied to corresponding pixels by producing a plurality of pulse waveforms in the source driver 200 is discussed in greater detail below.

The timing controller 600 outputs gradation data and control signal Sd to the source driver 200 and outputs a control signal Sg for controlling the scan driver 300 to the scan driver 300 after receiving R, G, B data that represents an image, horizontal synchronization signal Hsync and vertical synchronization signal Vsync from an outer image processing component that is not illustrated. Further, the timing controller 600 transmits a light source control signal Sb to a backlight controller 400 such that the backlight part 500 outputs a light to the LCD panel 100.

The backlight controller 400 applies a certain voltage for driving the backlight part 500 disposed on the rear surface of the LCD panel 100 to the backlight part 500 according to a backlight control signal Sb applied from the timing controller 600. The backlight part 500 can includes red, green and blue LEDs for sequentially outputting red, green and blue lights in the case of a field-sequential driving type, and the backlight part 500 can be a white LED or cold cathode fluorescence lamp for outputting white light in the case of a driving type using color filters. Further, red, green and blue color filters are formed on a common electrode per each unit pixel in the case of an LCD device being of the driving type using color filters.

Further, a high voltage (for example, about 15V to 30V) is applied to a common electrode 112 in the liquid crystal cells $C_{LC}$ to transition OCB liquid crystals in the LCD device from the bend state to an initial state. The LCD device further includes a DC-DC converter (that is not illustrated in the drawings) for applying the high voltage to the common electrode 112.

Figure 2:
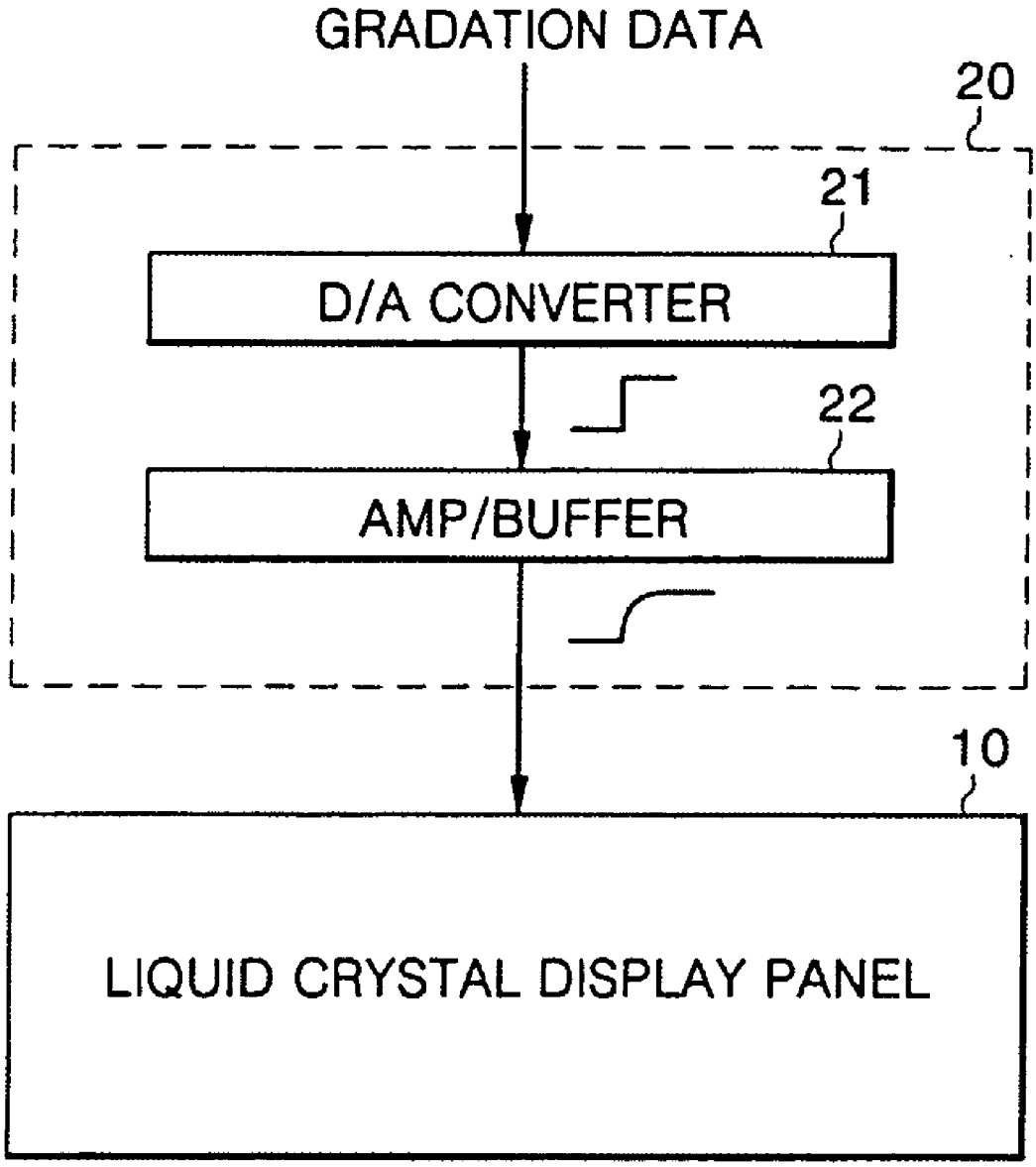
FIG. 2 is a block diagram illustrating a source driver of a conventional LCD device.

A conventional source driver outputs analog voltage by using a D/A converter 21 and an amp/buffer 22 (See FIG. 2, for example). However, since a plurality of pulse waveforms are sequentially applied from a source driver 200, a signal delay which is a problem of the conventional source driver is prevented or reduced and the response speed is increased in the LCD device according to exemplary embodiments of the present invention. The source driver of the LCD device according to exemplary embodiments of the present invention is described in detail in reference to FIG. 4 and FIG. 5.

Figure 4:
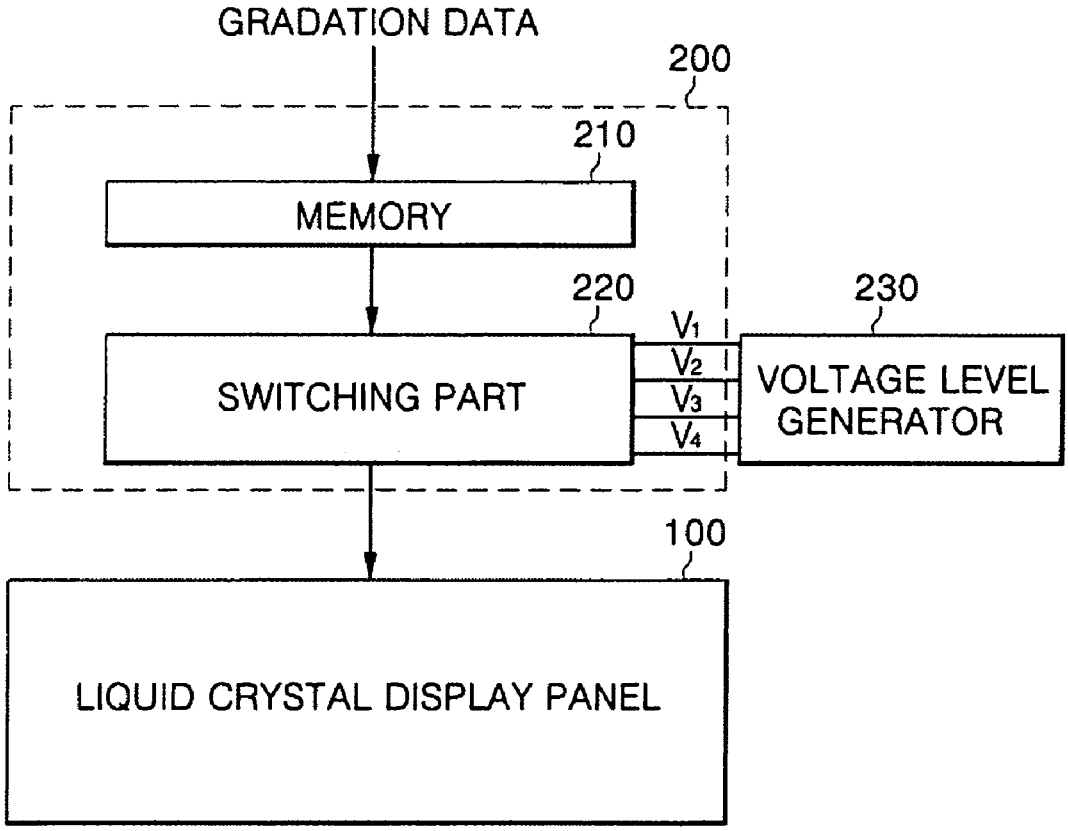
FIG. 4 is a block diagram illustrating a source driver of an LCD device according to exemplary embodiments of the present invention.

FIG. 4 is a block diagram illustrating a source driver of an LCD device according to exemplary embodiments of the present invention.

Referring to FIG. 4, the source driver 200 of an LCD device according to exemplary embodiments of the present invention includes a memory 210 and a switching part 220.

The memory 210 stores data values corresponding to a plurality of gradation data respectively in a lookup table and the corresponding gradation data are inputted into the memory 210 to sequentially transmit switching signals corresponding to the already stored data values to the switching part 220. The data values stored in the memory 210 are stored as n bits. A lookup table stored in the memory will be described in greater detail below referring to FIG. 5.

The switching part 220 includes a plurality of switching elements (that are not illustrated in the drawings) respectively connected to a plurality of data lines D1-Dm in an LCD panel 100, and the respective switching elements perform a switching action by receiving switching signals outputted from the memory 210. The respective switching elements include bipolar junction transistors (BJTs), metal-oxide semiconductor field-effect transistors (MOSFETs), multiplexers and similar components.

Further, the switching part 220 transmits the selected voltage levels to a plurality of pixels 110 by selecting voltage levels of multiple steps (V1, V2, V3 and V4 in FIG. 4) outputted from a voltage level generator 230 according to switching signals of the memory 210. Although it is described that the voltage level generator 230 produces voltage levels of multiple steps from the outside of the source driver 200, the voltage level generator 230 is not limited to that, but may be included in the source driver 200 so that the voltage level generator 230 is able to produce voltage levels of multiple steps. Further, voltage levels (e.g., V1, V2, V3 and V4) of four steps are described as an example in FIG. 4, less than four steps or more than four steps of voltage levels can be produced according to gradation data to be expressed.

Figure 5:
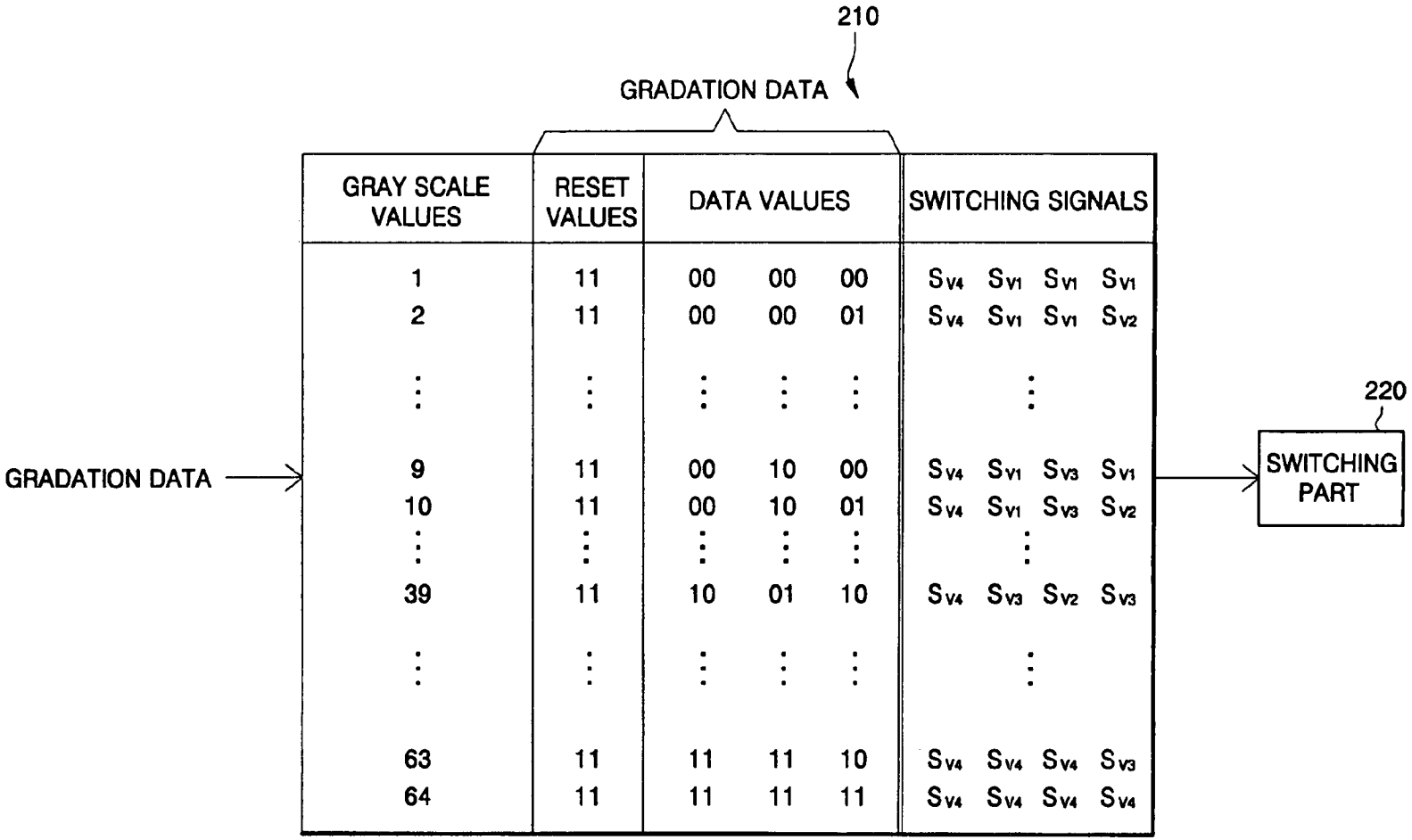
FIG. 5 is a drawing for explaining a memory of the source driver illustrated in FIG. 4 in which gradation data is stored in a lookup table format.

FIG. 5 is a drawing for explaining a memory of the source driver illustrated in FIG. 4 in which gradation data is stored in a lookup table.

FIG. 5 is described as follows in reference to FIG. 4. First, the memory 210 outputs a code of two bits as a switching signal applied to the switching part 220 so that a switching signal $S_{V1}$ is outputted to select voltage level V1 if the code is '00', a switching signal $S_{V2}$ is outputted to select voltage level V2 if the code is '01', a switching signal $S_{V3}$ is outputted to select voltage level V3 if the code is '10', and a switching signal $S_{V4}$ is outputted to select voltage level V4 if the code is '11'.

Further, gradation data of 8 bits are divided into 64 gray scale values such that the gradation data are stored according to each gray scale value. The first two bits in the gradation data of 8 bits are fixed to '11' as a reset value for resetting liquid crystals and represent that the maximum voltage V4 in the voltage levels V1, V2, V3 and V4 is applied to OCB liquid crystal cells. The fact that OCB liquid crystals are reset represents that light transmittance of liquid crystals for transmitting light coming from a backlight part 500 is substantially zero(the black state). The memory 210 transmits to the switching part 220 a switching signal $S_{V4}$ for applying a voltage level V4 to OCB liquid crystal cells during the early stage of each frame, thereby ensuring that OCB liquid crystals are in the initial state during the early stage of each frame such that pulse waveforms applied to the present frame always represent a constant gradation irrespective of pulses applied to a frame just prior to the present frame.

Next, the remaining 6 bits in the 8 bit gradation data are data values for representing luminance of light passing through liquid crystals, wherein pulse waveforms applied to each pixel are selected by combination of the four voltage levels V1, V2, V3 and V4 to set luminance corresponding to the 64 gray scale values in FIG. 5. That is, 6 bits are stored to switch relevant voltage levels correspondingly to desired gray scale values among the measured luminance values, for example, 64 gray scale values after respectively measuring luminance represented by sequentially applying combinable pulse waveforms that are able to come out of four voltage levels V1, V2, V3 and V4 to pixels to obtain a pulse waveform with luminance corresponding to each gray scale value. As described above, since the memory 210 outputs a code of two bits as a switching signal such that a switching signal $S_{V1}$ is outputted to select a voltage level V1 if the code is '00', a switching signal $S_{V2}$ is outputted to select a voltage level V2 if the code is '01', a switching signal $S_{V3}$ is outputted to select a voltage level V3 if the code is '10', and a switching signal $S_{V4}$ is outputted to select a voltage level V4 if the code is '11'. Data values of '00 00 00' are stored by measuring luminance values represented by sequentially applying voltage levels V1, V1 and V1 combinable into four voltage levels V1, V2, V3 and V4 to one pixel, data values of '00 00 01' are stored by measuring luminance values represented by sequentially applying voltage levels V1, V1 and V2 to one pixel, and data values of '00 00 10' are stored by measuring luminance values represented by sequentially applying voltage levels V1, V1 and V3 to one pixel. Pulse waveforms having a luminance value of 64 in the gray scale can be obtained by storing data values of '11 11 11' after continuously measuring luminance values represented by sequentially applying voltage levels V4, V4 and V4 to one pixel in the same manner as in the above. Therefore, when gradation data corresponding to respective gray scale values are inputted into the memory 210 having a lookup table, switching signals corresponding to stored reset values and data values are sequentially applied to the switching part 220 so that the selected voltage levels are applied to corresponding pixels by sequentially selecting voltage levels outputted from the voltage level generator 230. The number of data bits and voltage levels are freely adjustable according to selection of a setter, and less than 64 gray scale values or more than 64 gray scale values are easily settable although 64 gray scale values are stored by measuring luminance values when combinable three voltage levels among four voltage levels V1, V2, V3 and V4 are sequentially applied to data values of 6 bits as a typical example in FIG. 5. As described in the above, the structure of the source driver of an LCD device according to exemplary embodiments of the present invention and the memory that stores gradation data in a lookup table shape have been examined referring to FIG. 4 and FIG. 5. Next, a method for driving an LCD device according to exemplary embodiments of the present invention is described referring to FIG. 6.

Figure 6:
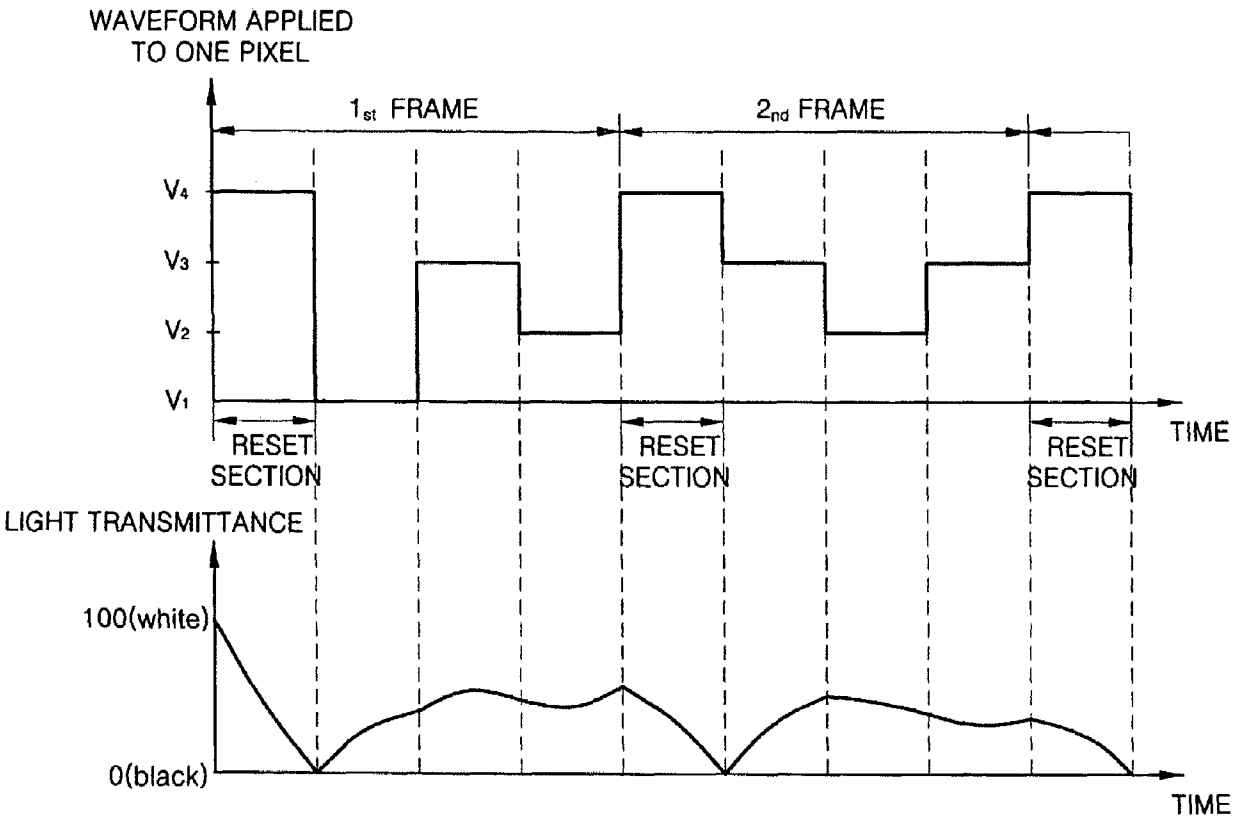
FIG. 6 is a waveform diagram illustrating a driving method of an LCD device according to exemplary embodiments of the present invention.

FIG. 6 is a waveform diagram illustrating a driving method of an LCD device according to exemplary embodiments of the present invention.

FIG. 6 is described as follows in reference to FIG. 4 and FIG. 5. The voltage levels of a pulse waveform applied to one pixel 110 by a source driver 200 are the four voltage levels V1, V2, V3 and V4, which are sequentially applied. Switching signals $S_{V4}$, $S_{V1}$, $S_{V3}$ and $S_{V2}$ corresponding to the bits '11 00 10 01' of the gradation data are sequentially applied to a switching part 220 since '11 00 10 01' of the 8 bits of the gradation data correspond to the tenth gray scale value that is stored in the memory 210. The gradation data corresponding to tenth gray scale value is applied to the source driver during the first frame as illustrated in FIG. 6. A switching part 220 to which the switching signals $S_{V4}$, $S_{V1}$, $S_{V3}$ and $S_{V2}$ are applied applies the selected voltage levels to relevant pixels 110 by sequentially selecting voltage levels V4, V1, V3 and V2 from the voltage level generator 230. Therefore, the liquid crystals of corresponding pixels have their light transmittance changed according to the sequentially applied voltage levels V4, V1, V3 and V2, wherein although light outputted from the backlight part is transmitted by a transmittance that is sequentially varied according to the light transmittance, a user will recognize luminance corresponding to the tenth gray scale value since light is transmitted at a degree of speed which is not recognized by the eye of a human being.

Next, the memory 210 sequentially applies switching signals $S_{V4}$, $S_{V3}$, $S_{V2}$ and $S_{V3}$ corresponding to the bits '11 10 01 10' to the switching part 220 since '11 10 01 10' of the 8 bit gradation data corresponds to the thirty ninth gray scale value stored in the memory 210 when the gradation data corresponding to thirty ninth gray scale value is applied to a source driver 200 during the second frame. A switching part 220 to which the switching signals $S_{V4}$, $S_{V3}$, $S_{V2}$ and $S_{V3}$ are applied applies the selected voltage levels to corresponding pixels 110 by sequentially selecting voltage levels V4, V3, V2 and V3 of a voltage level generator 230. Therefore, liquid crystals of corresponding pixels change light transmittance according to the sequentially applied voltage levels V4, V3, V2 and V3. An LCD panel 100 is displayed by driving the source driver 200 in this manner.

As described in the foregoing driving method of FIG. 6, '11' which are the first two bits among the eight bits and are fixed as a reset pulse corresponding to a voltage level V4 for always maintaining liquid crystals in the initialized state during the early stage of each frame is applied first in each frame so as to always display a constant gradation irrespective of a pulse waveform applied to a previous frame.

Since a memory 210 and a switching part 220 are newly constructed to enable various gradations to be displayed using voltage levels of a few steps in a source driver of LCD device according to exemplary embodiments of the present invention differently from a conventional source driver, the source driver of LCD device according to exemplary embodiments of the present invention sufficiently exhibits the benefits of a fast response speed of the OCB mode by solving a problem of slow response speed caused by a limit of slew rate of an output amp/buffer 22 displayed in the conventional source driver.

As described in the above, since an LCD device according to exemplary embodiments of the present invention include a source driver newly including a memory and a switching part that store gradation data in a lookup table to make various gradation displays possible using voltage levels of a few steps only, the LCD device according to exemplary embodiments of the present invention obtains an effect of solving a problem of slow response speed caused by a limit of a slew rate of the output amp/buffer displayed in the conventional source driver and an effect of sufficiently exhibiting merits of fast response speed of OCB liquid crystals.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A liquid crystal display device comprising:

a liquid crystal display panel comprising a plurality of pixels which are formed in a region where a plurality of scan lines and a plurality of data lines cross each other and comprise optically compensated bend (OCB) liquid crystal cells each comprising a common electrode, a pixel electrode and OCB liquid crystals;

a scan driver for applying scan signals for selecting the plurality of pixels through the plurality of scan lines;

a source driver for sequentially applying a plurality of pulse waveforms to the plurality of pixels through the plurality of data lines;

a backlight part for applying a light to the liquid crystal display panel;

a backlight controller for applying a backlight voltage to the backlight part; and a timing controller for applying control signals for controlling operation of the scan driver, the source driver and the backlight controller, wherein the source driver comprises a memory in which gradation data values are stored in a lookup table, and which sequentially outputs a plurality of switching signals corresponding to a gradation data inputted; and a switching part to which the plurality of switching signals are applied to sequentially select a plurality of voltage levels, and wherein the switching part sequentially applies to the respective pixels a plurality of pulse waveforms corresponding to the selected plurality of voltage levels during one frame.

2. The liquid crystal display device according to claim 1, wherein the source driver further comprises a voltage generation part for producing the plurality of voltage levels.

3. The liquid crystal display device according to claim 1, wherein the liquid crystal display device further comprises a voltage generation part for producing the plurality of voltage levels.

4. The liquid crystal display device according to claim 1, wherein the memory outputs switching signals for resetting the OCB liquid crystal cells at a beginning of each frame.

5. The liquid crystal display device according to claim 4, wherein the OCB liquid crystals have a light transmittance of substantially zero when resetting the OCB liquid crystal cells.

6. The liquid crystal display device according to claim 4, wherein the switching part selects a maximum voltage level in the plurality of voltage levels when resetting the OCB liquid crystal cells.

7. The liquid crystal display device according to claim 1, wherein the liquid crystal display device further comprises a DC-DC converter for applying voltage for bend transition of the OCB liquid crystals in an early stage of driving the common electrode.

8. The liquid crystal display device according to claim 1, wherein the switching part comprises a plurality of switching elements, and respective switching elements are connected to the plurality of data lines.

9. The liquid crystal display device according to claim 8, wherein each of the switching elements is a bipolar junction transistor (BJT), metal-oxide semiconductor field-effect transistor (MOSFET) or a multiplexer.

10. The liquid crystal display device according to claim 1, wherein the backlight part comprises a red LED, a green LED and a blue LED for sequentially emitting red, green and blue lights.

11. The liquid crystal display device according to claim 1, wherein the backlight part is a white LED or a cold cathode fluorescence lamp (CCFL) for emitting white light.

12. The liquid crystal display device according to claim 11, wherein the liquid crystal display device further comprises red, green and blue color filters for filtering light emitted from the backlight part.

13. The liquid crystal display device according to claim 1, wherein each of the plurality of pixels comprises a switching transistor for sequentially transmitting a plurality of pulse waveforms transmitted through the plurality of data lines to the pixel electrode of the OCB liquid crystal cells by responding to scan signals transmitted through the scan lines; and a storage capacitor for storing the plurality of pulse waveforms.

* * * * *